US005335414A

United States Patent [19]

Joyce et al.

[11] Patent Number: 5,335,414

[45] Date of Patent: * Aug. 9, 1994

[54] HEAT TRANSFER CELL AND MANUFACTURING APPARATUS

[75] Inventors: Roger L. Joyce, New Brighton; Ron Westby, Anoka, both of Minn.

[73] Assignee: Exaire Co., New Brighton, Minn.

[ * ] Notice: The portion of the term of this patent subsequent to Mar. 30, 2010 has been disclaimed.

[21] Appl. No.: 38,381

[22] Filed: Mar. 29, 1993

[51] Int. Cl.[5] ..... B23P 15/00

[52] U.S. Cl. ..... 29/726; 29/727; 72/187

[58] Field of Search ..... 29/726, 727; 72/187, 72/192; 100/153, 222

[56] References Cited

U.S. PATENT DOCUMENTS

| | | | |
|---|---|---|---|
| 4,984,673 | 1/1991 | Saito et al. | 72/187 |
| 5,186,034 | 2/1993 | Hunt | 72/187 |
| 5,197,318 | 3/1993 | Joyce et al. | 72/187 |

*Primary Examiner*—Irene Cuda

*Attorney, Agent, or Firm*—Haugen & Nikolai

[57] ABSTRACT

A heat transfer cell for employment in heating, ventilation and air conditioning applications, and an apparatus for producing metallic plates which can be employed in the construction of the heat transfer cell. The cell comprises a plurality of heat conductive plates stacked on each other and having upstanding fins extending substantially the length of each plate. A leading edge portion of each fin is folded laterally to thereby create a turbulent effect to air traveling linearly between adjacent fins and plates. The apparatus of the present invention comprises an endless chain having a plurality of generally equally spaced apart work supporting anvil links and a path deflecting, chain deflecting, idler roller operatively arranged to deflect the endless chain arcuately away from a preceding plane to thereby reduce the space between adjacent anvil links and simultaneously capture between the adjacent links a length of metallic material of a web traveling thereacross to thereby form a fin from the length of captured metallic material.

3 Claims, 4 Drawing Sheets

HEAT TRANSFER CELL AND MANUFACTURING APPARATUS

BACKGROUND OF THE INVENTION

The present invention relates generally to a heat transfer cell and manufacturing apparatus, and specifically to a heat transfer cell comprising a stack of plates each having upstanding fins whose leading and trailing edges enhance turbulent airflow to thereby improve heat exchange. The manufacturing apparatus provides for the formation of a plurality of generally regularly spaced apart upstanding fins along a web of metallic material.

In the past, various techniques have been employed for the formation and closing of fins on metallic webs for subsequent use in heat transfer cells. In the formation of such webs, gaps have been frequently found between the adjacent metallic layers forming the fins, with such gaps permitting air to become trapped therebetween and thereby effectively diminishing the heat transfer capability of the fins and hence the systems which are created which use such finned plates for the heat transfer cell. In copending and commonly assigned patent application Ser. No. 826,146, filed Jan. 27, 1992, a fin forming apparatus is disclosed which comprises a first endless chain and a second endless chain wherein the first chain has a plurality of supporting anvil links while the second chain has a plurality of work engaging, fin-forming male lugs extending outwardly and arranged to force metallic web portions between the anvil links to thereby accomplish fin-formation in a metallic web. Applicants have now developed a fin-forming apparatus comprising only a single endless chain having a plurality of generally equally spaced anvil links arranged therealong, thereby eliminating fin-forming male lugs present on a second endless chain. In such manner, heat conductive plates useable in heat transfer cells are efficiently produced.

Heat transfer cells are widely used in heating and ventilation systems of larger buildings, schools, shopping centers and the like. The cells function to conserve and use heat from warm air being expelled by transferring this heat to entering cold air. One popular type of cell construction is a stack of heat conductive metal plates where each plate has a plurality of parallel fins which act to form channels in which air travels and also provides structural stability to the stack. The fins of each immediately adjacent plate are usually disposed at about 90 degrees to the fins of the reference plate, and heat exchange occurs as warm air and cold air travel through the cell at 90 degrees to each other. In particular, heat from the warm air which is being expelled is transferred through the metal plate with which it is in contact to the opposite side of the plate which is in contact with incoming cold air to thereby add warmth to the incoming air prior to ambient or furnace introduction.

Prior art configuration of the leading edge portions and trailing edge portions of the upstanding fins generally has been smooth, and resultant air travel through the fin-formed channels has been non-turbulent. However, we have found that turbulent air travel through the channels results in greater heat transfer from expelled warm air to incoming cold air as well as reduced cross-contamination of incoming air and exiting air.

OBJECTS

It is therefore a primary object of the present invention to provide a heat transfer cell wherein air entrances thereto have turbulent flow enhancement means.

Still another object of the present invention is to provide a heat transfer cell wherein the turbulent flow enhancement means comprises a lateral fold of each fin at its leading edge portion.

Yet another object of the present invention is to provide an improved apparatus for creating a plurality of generally regularly spaced apart upstanding fins along a web of metallic material which then can be employed in the construction of a heat transfer cell.

These and other objects of the present invention will become apparent throughout the description which now follows.

SUMMARY OF THE INVENTION

The present invention is a heat transfer cell for employment in heating, ventilation and air conditioning applications, and an apparatus for producing metallic plates which can be employed in the construction of the heat transfer cell. The heat transfer cell comprises a plurality of heat conductive plates stacked on each other. Each of the plates has a plurality of parallel, generally regularly spaced apart, upstanding fins extending substantially the length of the plate. During operation, air travels between the plates and each plate is provided with turbulent flow enhancement means. In a preferred embodiment, a leading edge portion of each fin is folded laterally to thereby create a turbulent effect to air traveling linearly between adjacent fins. The plates are arranged so that the fins of one plate of the stack are disposed at about 90 degrees from the fins of the immediately adjacent plates of the stack.

The apparatus of the present invention which can be employed for producing metallic plates to construct a heat transfer cell of the instant invention comprises, first of all, a frame means, an endless chain, a means for driving the endless chain along a predetermined path, with the chain having a plurality of generally equally spaced apart work supporting anvil links. The apparatus further comprises a path deflecting, chain deflecting idler roller operatively coupled to the frame means and arranged to deflect the endless chain arcuately away from a preceding plane to thereby reduce the space between adjacent anvil links and simultaneously capture between the adjacent links a length of metallic material of a web of metallic material traveling thereacross to thereby form an upstanding fin from the length of captured metallic material. In this manner, a plurality of regularly spaced apart upstanding parallel fins are formed along the web of metallic material. Thereafter, the web of finned metallic material can be cut to size as required for constructing the heat transfer cell.

DETAILED DESCRIPTION OF THE PREFERRED EMBODIMENT

Figure 1:
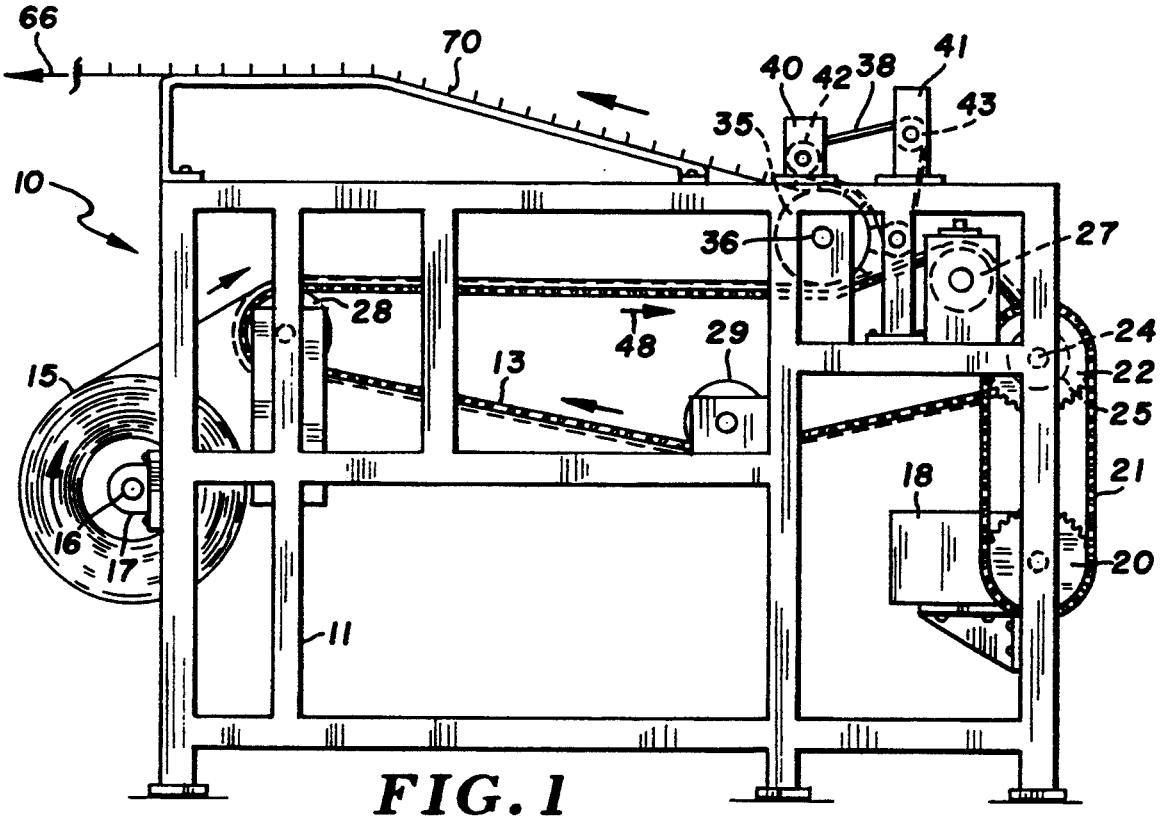
FIG. 1 is a side elevational view of a fin-forming apparatus in accordance with the present invention.
Figure 2:
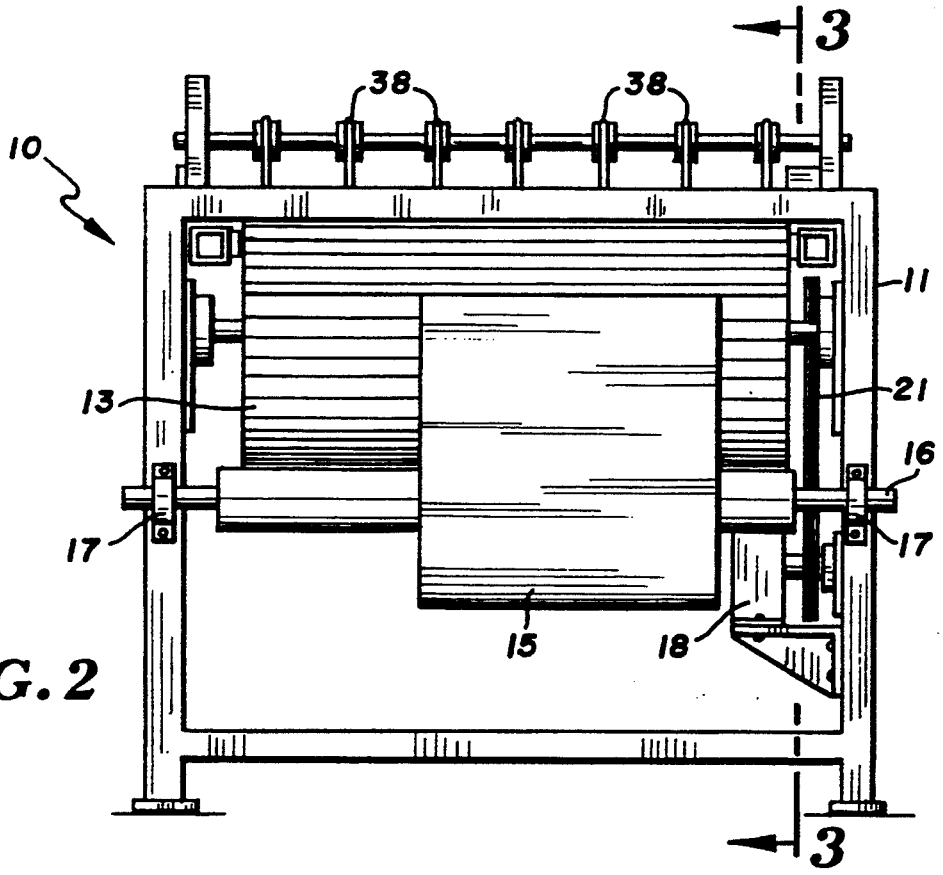
FIG. 2 is an end elevational view taken at the infeed end of the apparatus of FIG. 1.

As shown in FIGS. 1 and 2, the fin-forming apparatus 10 of the present invention includes frame means 11 supporting an endless chain 13 in operative relationship thereon. A web 15 of metallic material is mounted on frame 11, as illustrated with the web 15 being supported by a shaft 16 in a pair of opposed bearing members 17. A drive motor 18 is provided for rotational motion of drive sprocket 20, with sprocket 20 on motor 18 providing continuous motion to the drive chain 21. Drive chain 21 is in mesh with driven sprocket 22, with sprocket 22 being fast on shaft 24, thereby providing drive motion to chain 13 through conveyor chain drive cylinder 25. A number of drive and idler cylinders are provided along the path of endless chain 13, with idlers being shown at 27 and 29, and with an additional main guide or idler cylinder being shown at 28. As is conventional, each of the drive cylinders and idler cylinders is rotatably journaled for rotation on frame 11 by conventional bearing means as would be recognized by a skilled artisan. The chain 13 moves in the direction of arrow 48.

Figure 3:
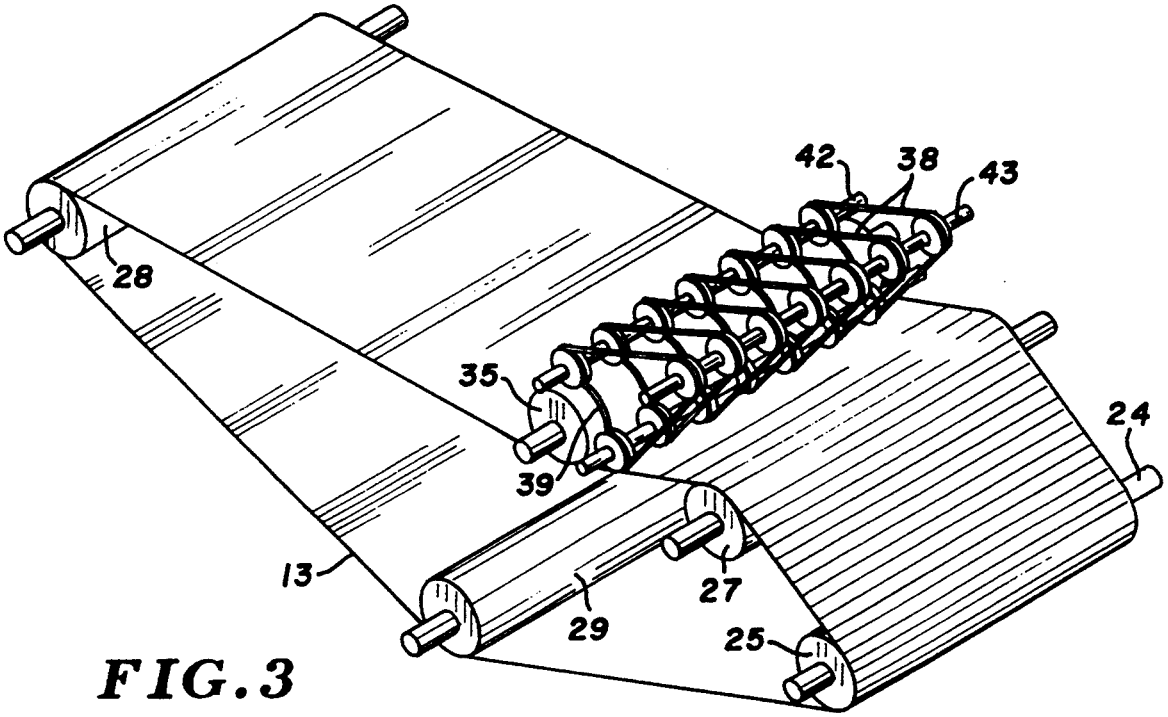
FIG. 3 is a perspective view taken generally along line 3—3 of FIG. 2.
Figure 4:
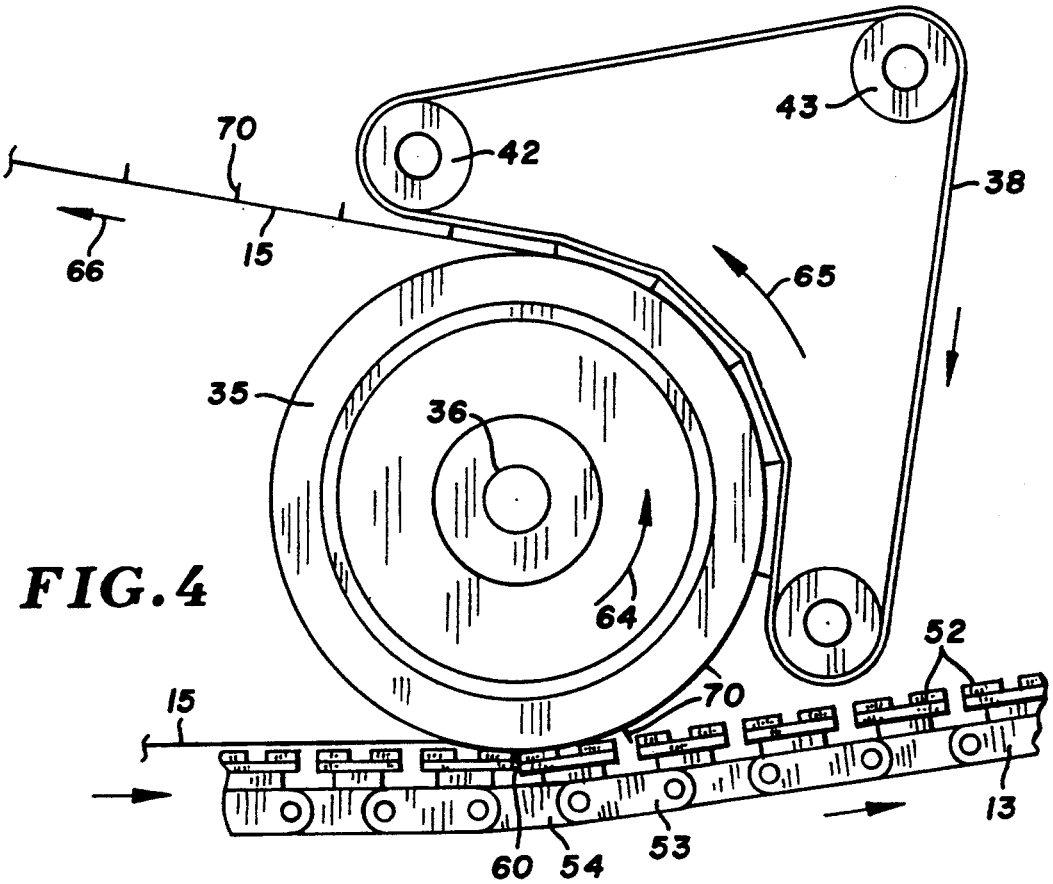
FIG. 4 is an enlarged side elevational view of the fin formation site of the apparatus of FIG. 1.

As shown in FIGS. 1, 3 and 4, idler roller 35 is provided adjacent the endless chain 13, and is designed to provide a path defining, chain deflecting force to the chain 13. Idler roller 35 is journaled appropriately on shaft 36, as indicated in FIGS. 1 and 4. An attachment is provided to idler roller 35 in the form of take up means, including spaced apart belts 38, operatively arranged to move along a portion of the outer surface of idler roller 35, such as illustrated at 39 (FIG. 3). The belts 38 move in the direction of arrow 65 (FIG. 4). Suitable support brackets are disposed as at 40 and 41 for appropriately retaining shafts 42 and 43 journably supported in defining the operative paths of the belts 38.

As shown in FIG. 4, the chain 13 comprises a plurality of generally equally spaced apart work supporting anvil links 52 which are, in turn, supported directly on chain links as at 53 and 54 respectively. The chain links 53 and 54 are conventional in the art, and means are well known for attaching members such as anvil links 52 to the chain.

In operation, metal of the web 15 is fed on the chain 13 to pass between the chain 13 and the idler roller 35 which rotates in the direction of arrow 64 in FIG. 4. As the metal approaches the roller 35, which is preferably constructed of a resilient material such as rubber, the metal and the chain 13 are deflected, resulting in a length 60 of the metal being captured between adjacent links 52 as shown in detail in FIG. 4. As this captured length 60 of metal passes directly beneath the roller 35, the adjacent links 52 along with the captured length 60 of metal therebetween are forced tightly toward each other due to the travel path of links 52 becoming curved, resulting in the bulging of the metal length 60 and the formation of a fin 70. This bulging is necessitated by the fact that the roller's circumference has an angular speed less than the linear speed of chain 13 at the point of deflection. In like manner fins 70 are formed along the entire web 15 at generally regularly spaced apart intervals. As is indicated by arrow 66 (FIG. 1), web 15, when finished, moves outwardly of the apparatus 10 along and in the direction of arrow 66 for ultimate collection or severing. At this point, the substantially continuous web 15 is severed into individual web segments, with each having a length appropriate for the application required. Various shear die mechanisms, all of which are well known in the art, may be utilized for this severing operation.

Figure 5:
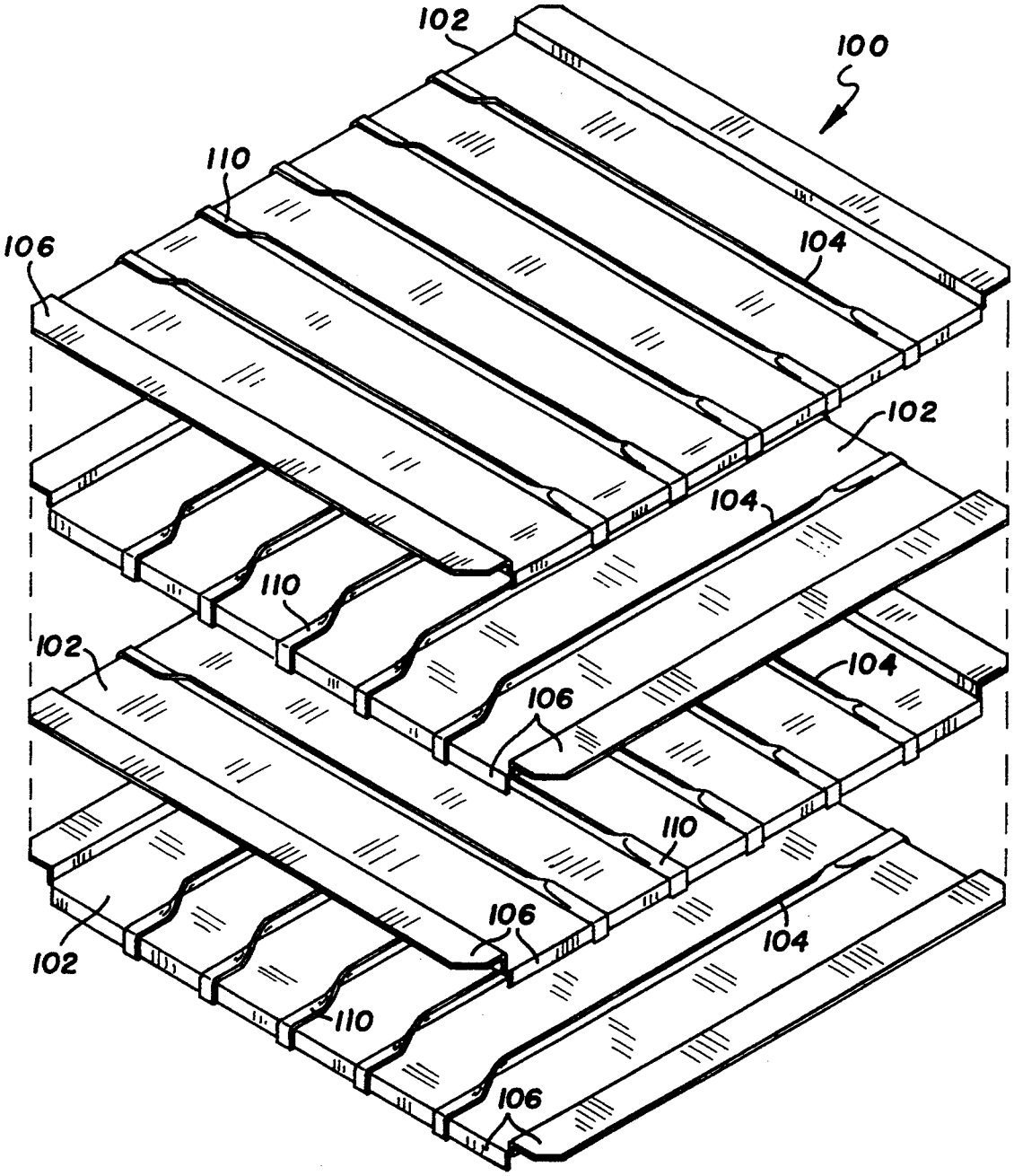
FIG. 5 is an exploded perspective view of a heat transfer cell.
Figure 6:
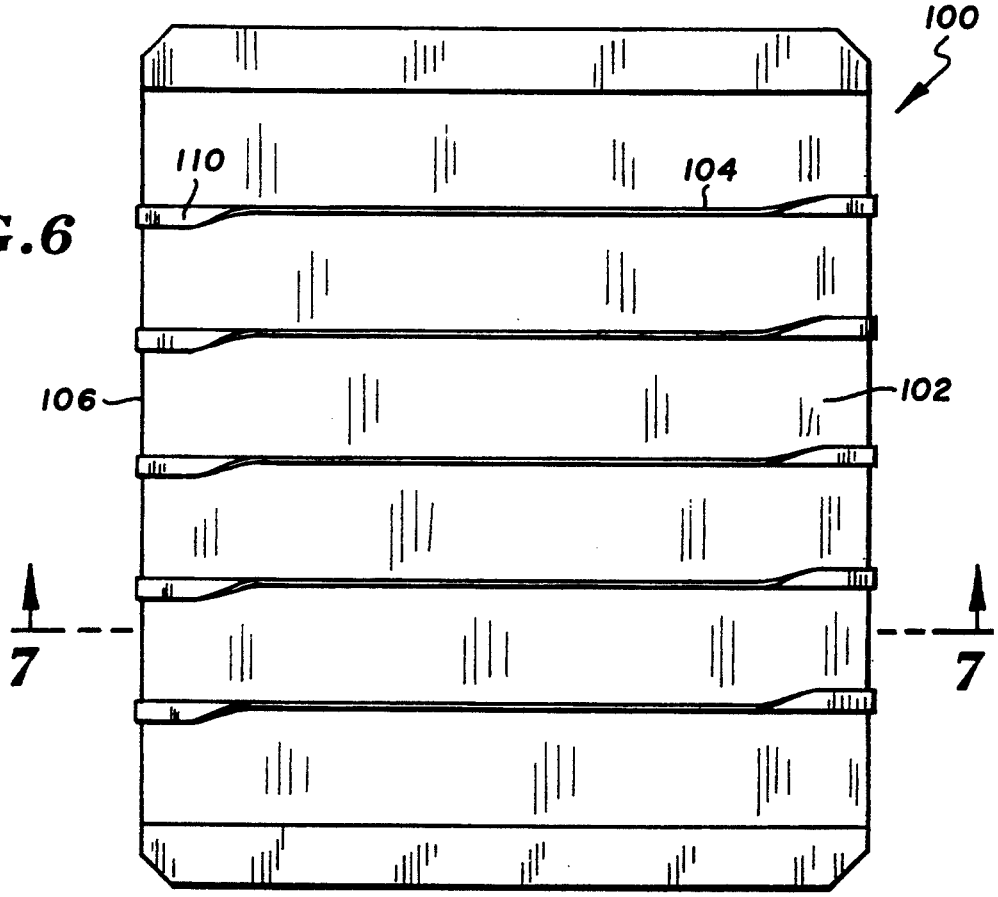
FIG. 6 is a top plan view of the assembled cell of FIG. 5.
Figure 7:
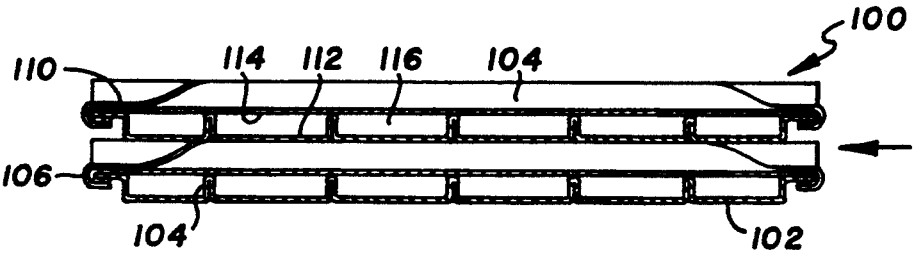
FIG. 7 is a side elevational view of the assembled cell along line 7—7 of FIG. 6.
Figure 8:
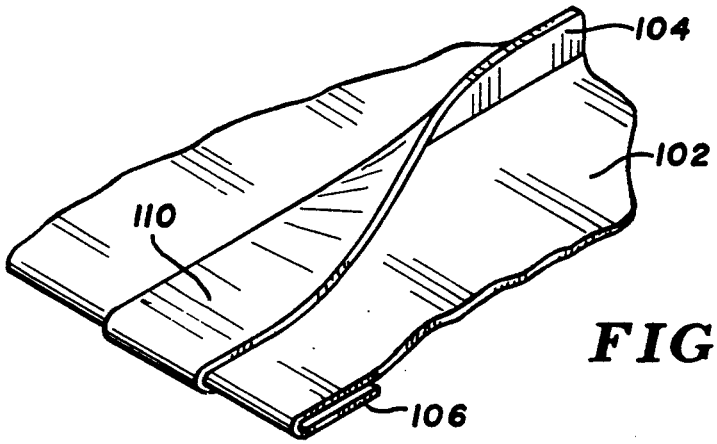
FIG. 8 is an enlarged perspective view of a portion of the leading edge of a fin of the cell of FIGS. 5–7.

Referring to FIGS. 5–7, a heat transfer cell 100 is shown. The cell 100 comprises a plurality of heat conductive, preferably aluminum, thin plates 102 stacked on top of each other, with the upstanding fins 104 of one plate situated at 90 degrees from the fins of 104 of each immediately adjacent plate. The fins 104 extend substantially the length of each plate 102 when the cell 100 is assembled. Thus, while each plate 102 has a border 106 therearound prior to assembly of the cell 100, the borders 106 are bent upwardly or downwardly to be used in securing immediately adjacent plates together, resulting in a final cell configuration where the fins 104 extend substantially the length of the plates 102. The fins 104 of each plate 102 are parallel to each other and generally regularly spaced apart from each other. Each edge portion of each fin 104 is folded laterally as clearly shown in FIG. 8. Thus, the leading edge of each fin 104 presents a lateral fold 110 to air traveling linearly as it enters the cell 100. This lateral fold 110 creates a turbulence to entering air and thereby aids in the uniform distribution of the air traveling between adjacent fins 104 to the floor 112 and the ceiling 114 of each channel 116 defined by these fins 104, floor 112 and ceiling 114. The lateral fold 110 also inhibits cross-contamination of entering air and exiting air.

In operation, warm air being expelled from a building through the cell 100 enters the cell 100 at 90 degrees to incoming cold air coming through the cell 100 for subsequent distribution within the building, with both air flows traveling between respectively situated upstanding fins 104. Because both the warm and cold air flows are turbulently moving through the cell 100 at plate locations adjacent each other, each flow is swirled against the floor 112 and ceiling 114 of its channel 116 by the lateral fold 110 of each fin 104 to thereby enhance heat movement from the warm expelled air through the heat conductive plate 102 to the cold airflow immediately above and below. This enhanced heat movement occurs, of course, because flowing-air contact with plate surfaces is enhanced by the turbulence which results in improved overall air contact with the heat conductive plates to thereby permit greater heat transfer than that experienced with a laminar airflow pattern. In this manner, heat conservation can occur and resulting benefits include reduced use of fuel along with greater economy and efficiency.

As is apparent, construction of the heat conductive plates 102 of the cell 100 can be accomplished by the apparatus 10 described above. In particular, the apparatus 10 can be employed to produce the fins 104 in the plates 102. Subsequently, the web of material having fins 104 can be subjected to an appropriately placed pressured roller as would be recognized in the art to fold the edge portions of each fin 104 laterally and thereby produce the lateral folds 110.

While an illustrative and presently preferred embodiment of the invention has been described in detail herein, it is to be understood that the inventive concepts may be otherwise variously embodied and employed and that the appended claims are intended to be construed to include such variation except insofar as limited by the prior art.

We claim:

1. An apparatus for the formation of a plurality of generally regularly spaced-apart upstanding fins along a web of metallic material, the apparatus comprising:

(a) a frame means, an endless chain operatively coupled to the frame means, and means for driving the endless chain along a predetermined path, said chain having a plurality of generally equally spaced-apart work-supporting anvil links; and (b) a path-deflecting, chain-deflecting idler roller operatively coupled to the frame means and arranged to deflect the endless chain arcuately away from a preceding plane to thereby reduce the space between adjacent anvil links and simultaneously capture between said adjacent links a length of metallic material traveling thereacross to form an upstanding fin from said length of captured metallic material.

2. An apparatus as claimed in claim 1 wherein the idler roller is a resilient material.

3. An apparatus as claimed in claim 1 wherein means for receiving a supply roll of metallic material are coupled to the frame means and disposed for delivery of a web of metallic material between the endless chain and the idler roller.

* * * * *